United States Patent [19]

Kinner

[11] Patent Number: 4,825,596

[45] Date of Patent: May 2, 1989

[54] FLYWHEEL RESURFACING METHOD AND APPARATUS

[76] Inventor: James Kinner, 1620 16th Ave., San Francisco, Calif. 94122

[21] Appl. No.: 234,384

[22] Filed: Aug. 19, 1988

Related U.S. Application Data

[63] Continuation-in-part of Ser. No. 943,922, Dec. 18, 1986, Pat. No. 4,766,702.

[51] Int. Cl.[4] ..... B24B 1/00; B24B 7/00

[52] U.S. Cl. ..... 51/281 SF; 51/132; 51/DIG. 3; 51/165.8

[58] Field of Search ..... 51/132, 281 SF, DIG. 3, 51/165.9, 165.81, 165.8, 165.71

[56] References Cited

U.S. PATENT DOCUMENTS

| | | | |
|---|---|---|---|
| 3,407,543 | 10/1968 | Gebel | 51/165.9 |
| 3,456,401 | 7/1969 | Kushmuk | 51/259 |
| 3,500,589 | 3/1970 | Ellege | 51/259 X |
| 3,548,549 | 12/1970 | Dunn | 51/118 |
| 3,619,952 | 11/1971 | Leming et al. | 51/132 X |
| 4,361,988 | 12/1982 | Gramlich | 51/132 X |
| 4,525,957 | 7/1985 | Daniels | 51/131.1 X |

*Primary Examiner*—Debra Meislin

*Attorney, Agent, or Firm*—Thomas M. Freiburger

[57] ABSTRACT

A method and apparatus for surfacing the face of a clutch flywheel or other friction disk achieves a surface pattern which promotes proper wearing-in of the flywheel or disk and of a friction disk or pad which engages the disk. The abrasive surface of a rotating abrading wheel is applied to a disk rotating in the same angular direction as that of the abrading wheel. A rotating cup-shaped abrading wheel is tilted slightly with respect to the frictional contact surface of the disk so that only one portion of the wheel engages the disk at a time resulting in a resurface pattern of lines that essentially do not cross over each other. Advancement of the abrading wheel against the flywheel or disk may be automatically controlled in fine adjustment mode. Current drawn by the abrading wheel motor is sensed, and when it is below a preset level a lead screw motor is automatically powered to advance the abrading wheel against the disk. When current reaches the preset point, the lead screw motor is stopped.

11 Claims, 4 Drawing Sheets

FLYWHEEL RESURFACING METHOD AND APPARATUS

BACKGROUND OF THE INVENTION

This is a continuation-in-part of my copending application Ser. No. 943,922, filed Dec. 18, 1986, now U.S. No. 4,766,702.

This invention relates generally to machines and methods, for resurfacing the opposed faces of a disk-shaped workpiece, and in particular relates to a novel machine and system for refinishing clutch flywheels to achieve a desired pattern.

Motor vehicle clutches normally have a flywheel as a retarding element to be engaged by a friction disk or pressure plate. The pressure plate is usually lined with high-friction material, whereas the clutch flywheel itself is usually of metal so as to dissipate the heat of friction rapidly and remain sturdy during operation.

In order to achieve proper clutching action, it is desirable that the face of the flywheel, like those of a brake disk, be parallel and smooth. However, long or hard use of the clutch tends to roughen or groove the face. Furthermore, rust and contamination may develop with time. Accordingly, refinishing of the clutch flywheel surface is often necessary.

Refinishing of brake disks is normally done on a lathe. U.S. Pat. No. 3,456,401 to Kushmuk, for example, shows a brake disk resurfacing apparatus which is used as an attachment to a lathe. U.S. Pat. No. 3,500,589 to Ellege, which shows a two-step resurfacing process, similarly discloses use of a lathe. Other resurfacing methods are also disclosed in the art: U.S. Pat. No. 3,619,952 to Leming et al., for example, shows the use of resilient finishing disks after turning. Additionally, U.S. Pat. Nos. 4,361,988 to Scharfen and 3,548,549 to Dunn disclose the use of opposed cutting members and opposed grinders, respectively. These prior designs all necessitate the use of large machine tools, in most cases brake lathes, which are quite expensive and are furthermore fairly difficult and unwieldy to use as well as difficult to assemble and disassemble. Finally, disks resurfaced by prior art methods, which have a concentric pattern of resultant machined "lines," in a "phonograph" pattern, tend to wear unevenly and display a tendency to glaze.

Clutch flywheels have often been resurfaced on a machine having a rotating abrading element which made full-face contact with the frictional contact area of the flywheel surface. The resulting complex pattern caused glazing of the flywheel surface in operation.

This invention is directed to a new machine and method for refinishing clutch flywheels and other disks such as brake disks, and constitutes a significant improvement over the prior art. The apparatus of the invention is relatively compact. Additionally, the apparatus is fairly simple to assemble and disassemble, as it is comprised of relatively simple component parts; thus, it can be manufactured economically. Flywheels and disks refinished by the method of the present invention have a substantially reduced tendency to wear unevenly, and are provided with greatly improved surface pattern and parallelism. In addition, friction pad seating ability and parallelism of the flywheel surface, according to testing done by the inventor of the instant invention, is substantially improved and there is thus less of a tendency to develop wave patterns that are inherent in metal disks resurfaced by prior art methods which have concentric patterns. Disks resurfaced by the prior art methods display a surface pattern that is conducive to galling and glazing; thus, with the new method, metal disks may be resurfaced far less frequently, and flywheels and disks which otherwise might be thrown away can be salvaged.

SUMMARY OF THE INVENTION

Accordingly, it is an object of the present invention to provide a method of grinding and resurfacing flywheels and other metal disks which produces a greatly improved surface pattern, thus obviating the need for frequent resurfacing and promoting proper wear.

It is still a further object of the present invention to provide a relatively compact apparatus for grinding disks and flywheels, which apparatus is comprised of relatively simple component parts, is fairly easy to assemble and disassemble, and is relatively inexpensive to manufacture.

In one aspect of the present invention, an abrading wheel is applied to the rotating surface of a flywheel. The flywheel disk is caused to rotate by means of a drive shaft which supports the disk and extends perpendicularly through its axis of rotation. Disc rotation speed may be adjusted by means of a potentiometer.

In another aspect of the present invention, the abrading wheel is caused to rotate in an angular direction the same as that of the rotating flywheel. Coarse and fine adjustment mechanisms are included in order to direct the movement of the abrading wheel. In one preferred embodiment of the invention, the adjustment mechanisms comprise an interlocking worm gear. The fine adjustment may be driven by a motor with sensor control, based on abrading wheel current draw, for controlling the grinding pressure and resistance.

The rotating cup-shaped abrading wheel is tilted slightly with respect to the disk surface, so that only one portion of the wheel engages the disk at a time.

Other objects, advantages and features of the invention will be apparent from the following description of a preferred embodiment, considered along with the accompanying drawings.

DESCRIPTION OF THE DRAWINGS

FIG. 1 is a partially cut away top plan view of the grinder.

DESCRIPTION OF PREFERRED EMBODIMENT

Figure 1:
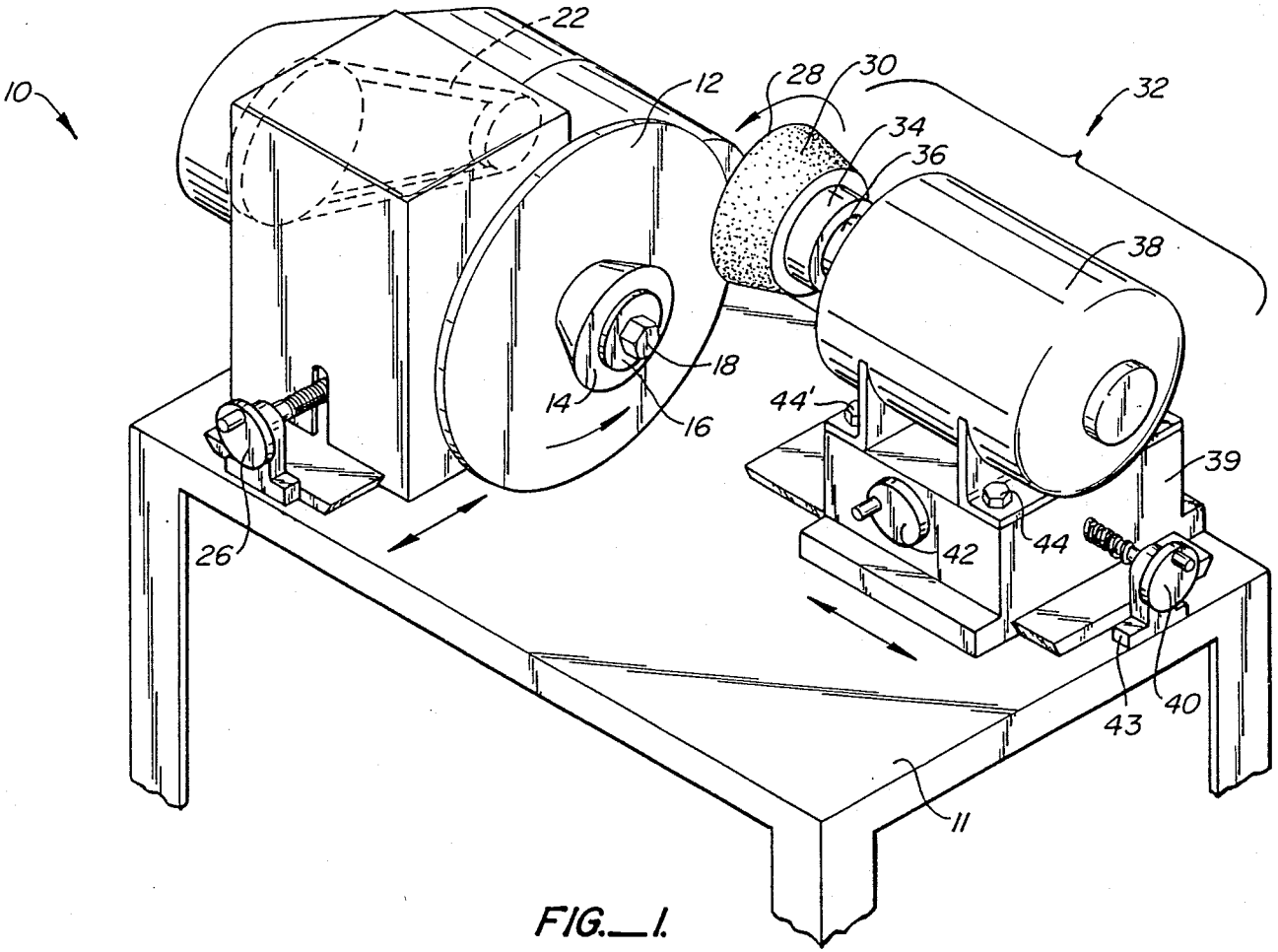
FIG. 1 is a perspective view of the clutch flywheel and disk grinder of the invention.

In FIG. 1, the clutch flywheel grinder of the invention is shown generally at 10, is preferably mounted on a level surface such as a table 11. A flywheel or other grindable disk 12 is shown mounted and held in place by means of a centering device 14, a washer 16, and a centering bolt 18. The flywheel 12 is caused to rotate about its axis of rotation by means of a drive belt 22. When no longer in operation, the linear position of the flywheel may be adjusted by means of a disk adjustment knob 26 operatively connected to a drive shaft 20 (see FIG. 2). When in operation, the abrasive surface 28 of an abrading wheel 30 is caused to contact the disk or flywheel 12, thereby smoothing the disk and producing a ground pattern of lines 31 generally in the form of curving grooves extending outwardly from the center of the flywheel toward the flywheel perimeter (see FIGS. 5 and 6). This pattern, in contrast to the pattern of concentric circles produced by the machining methods of the prior art, contributes to the surprising improvement in results achieved by the present invention.

Part of the abrading wheel assembly 6 shown generally at 32, the abrading wheel 30 extends toward the flywheel 12 from the motor 38. The abrading wheel is preferably of the cup-shaped type as shown in the drawings. The wheel is rotated, preferably in an angular direction the same as that of the disk or flywheel 12 as shown by arrows in FIG. 1. Superior results are achieved when the rotation speed of the disk 12 is at least approximately 400 rpm, and that of the abrading wheel at least about 3450 rpm. The abrading wheel 30 is rotated by means of the motor 38, and is operatively connected to the abrading wheel assembly shaft 36. The abrading wheel assembly 32 is mounted to the table 11 by means of bolts 44 and 44'. The position of the abrading wheel relative to the flywheel 12 may be adjusted by means of a coarse adjustment knob 40 and a fine adjustment knob 42.

Figure 2:
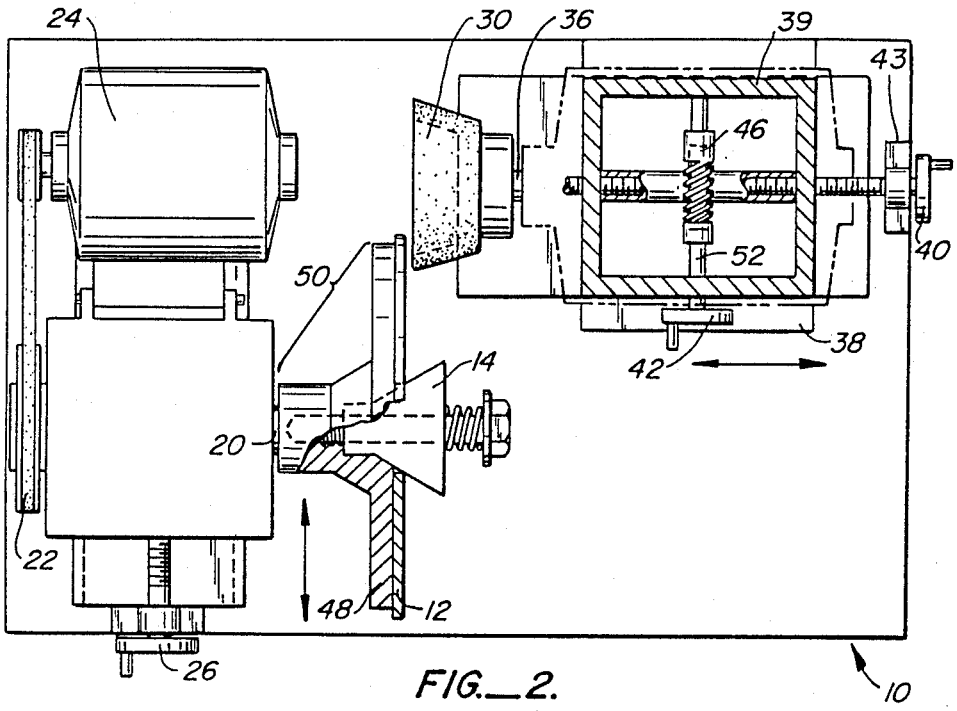
Figure 3:
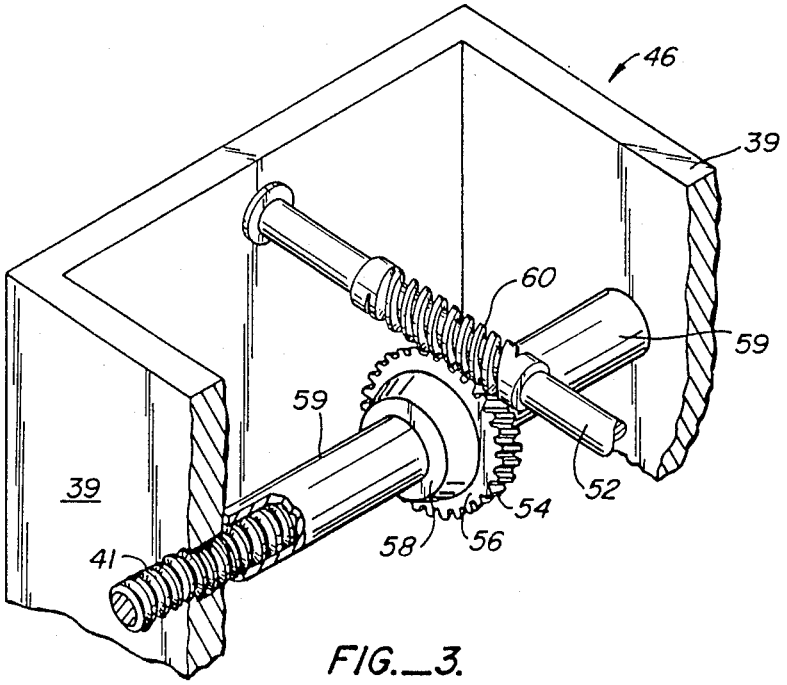
FIG. 3 is a cut away view of the abrading wheel adjustment mechanism.

The flywheel grinder is shown in somewhat more detail in FIGS. 2 and 3. In FIG. 2 the mounting assembly is seen in a partially cut away view. The flywheel 12 is held in place on the drive shaft 20 by means of a tapered, generally conical centering device 14, engaged against an opening in the flywheel or disk by a bolt 15 and spring 17. The spindle and drive plate assembly 50 is caused to rotate by means of a drive belt 22 driven by the motor 24.

The operational mechanism of the coarse adjustment knob 40 and the fine adjustment knob 42 may be seen in FIG. 2 and in somewhat more detail in FIG. 3. As may be seen, coarse and fine adjustment of the positioning of abrading wheel 30 relative to the disk 12 is effected by means of a worm gear arrangement shown generally at 46. The worm gear arrangement operates by means of evenly spaced teeth 54 on a worm gear 56 on a coarse adjustment shaft 41 by means of an adapter 58, the teeth interlocking one-for-one with threads 60 of a worm or screw on a fine adjustment shaft 52.

As can be clearly seen from FIGS. 2 and 3, the coarse and fine adjustments operate as follows: The coarse adjustment knob 40 and shaft 41 are rotated to shift the position of the housing 38 via a base 39. The knob 40 and shaft 41 rotate but do not move axially because they are held against axial movement by a bracket 43 as shown in FIG. 1. Movement of the base 39 is effected by threaded engagement between the threaded shaft 41 and internal threads of the worm gear of adapter 58 (if it is fixed to the worm gear). Rotation of the shaft therefore causes the worm gear to move axially while remaining non-rotational, and this motion is transferred to the base 39 by free-floating spacer sleeves 59 positioned somewhat loosely over the shaft 41 as shown. Rotation of the shaft 41 therefore causes movement of the base axially with respect to the shaft 41, in a coarse adjustment mode. However, if the fine adjustment knob 42 and shaft 52 and worm threads 60 are rotated, the worm gear 56 will rotate very slowly, advancing along the now stationary threads of the coarse adjustment shaft 41 and causing the base 39 to advance very slowly, axially with respect to the shaft 41 and the bracket 43.

Figure 4:
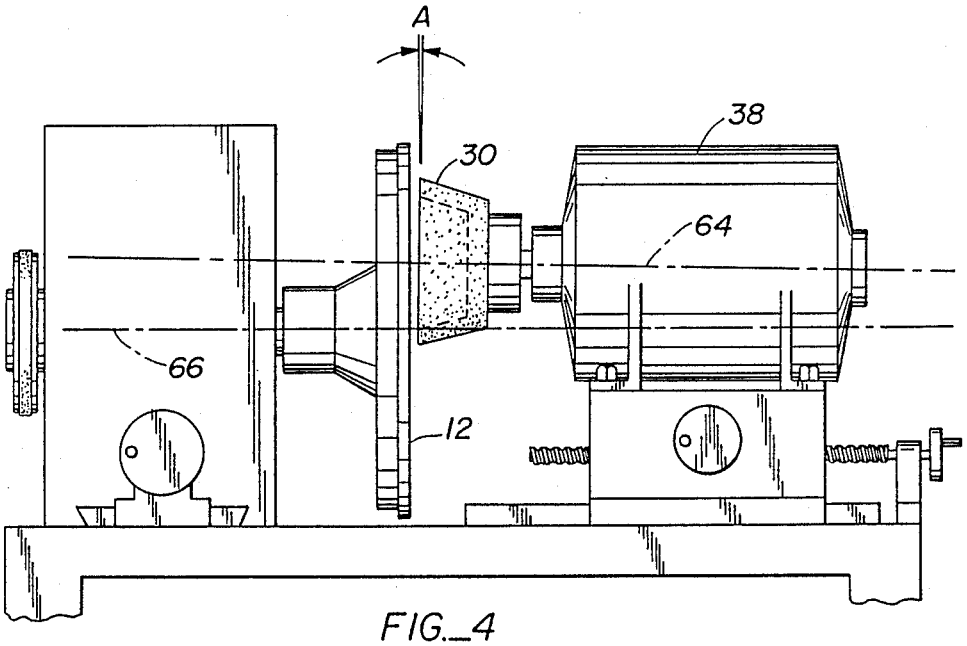
FIG. 4 is a side elevation view illustrating the slight tilt of the abrading wheel with respect to the flywheel.
Figure 5:
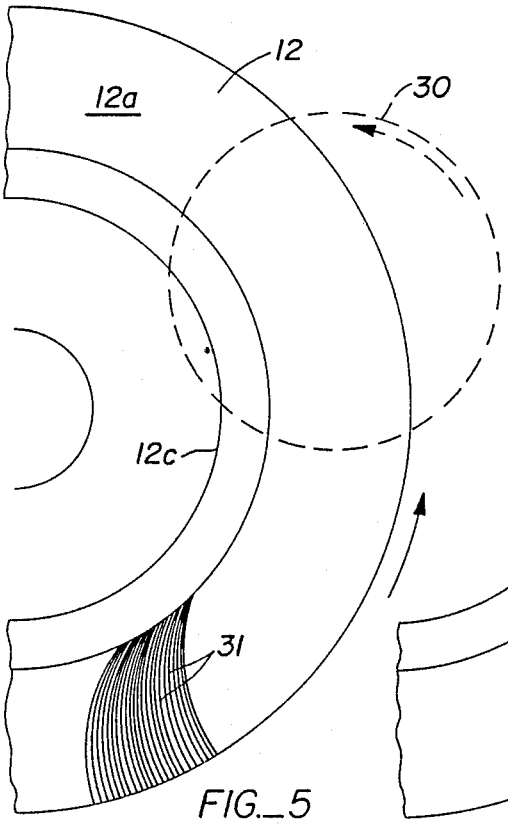
FIG. 5 is a fragmented frontal view of one surface of a flywheel or disk, showing the surface pattern achieved by the machine and method of the invention.
Figure 6:
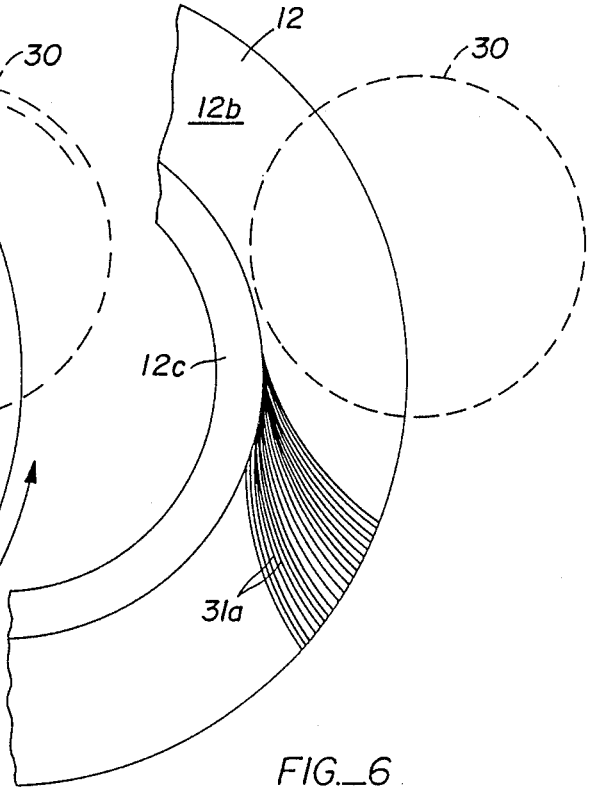
FIG. 6 a frontal view of the opposite surface of the flywheel, showing the resurfacing pattern on that side.

FIGS. 4, 5 and 6 illustrate the system and method of the invention for achieving a resurface pattern which is highly effective in promoting proper wearing-in of the flywheel disk and the friction disk or pad or pressure plate which engages it.

As shown in FIG. 4, the abrading wheel 30 is on an axis of rotation 64 which is slightly tilted from parallelism with an axis of rotation 66 of the flywheel and its rotating assembly. The two axes are at a small angle A from each other, which may be about 1°. This assures that only one section of the cup-shaped abrading wheel's face will contact the flywheel or disk 12, to produce the surface grinding patterns 31 and **31*a* shown in FIGS. 5 and 6. In the arrangement shown, generally the lower area of the face of the abrading wheel 30** contacts the flywheel, while the upper area of the face remains spaced from the flywheel.

FIG. 5 shows in dashed lines the general position of the abrading wheel 30 as it engages the flat face **12*a* of a flywheel or disk 12, as the disk is shown positioned in FIG. 4. The grinding wheel 30, when engaging this unobstructed flywheel face 12*a*, preferably generally straddles the annular frictional area of the face 12*a* as shown in FIG. 5. Only the lower edge or portion of the wheel 30 engages the flywheel face 12*a*, but because both the wheel 30 and the flywheel 12 are rotating in the direction indicated, a surface pattern of curving lines 31 is generated. The curving lines 31 are not truly arcuate, but each is of varying radius generally as shown. The lines 31 are generally transverse to the circumference of the flywheel and to the path of engagement of the friction pad or disk or pressure plate with the face 12*a*. Thus, the lines 31** are "generally radial," with respect to the general direction in which they sweep across the contacting friction disk or pad.

FIG. 6 shows the position of the abrading wheel 30 on the opposite side of the disk 12, for the case wherein a two-sided disk such as a brake disk is to be resurfaced. The wheel 30 engages the frictional surface area **12*b*. On this side of the disk is a hub 12*c*, schematically indicated in FIG. 6. The hub prevents the abrading wheel 30 from moving any closer to the center of the disk 12. The resulting resurfaced pattern of lines 31*a* is shown generally in FIG. 6**. Again, the surface lines are generally radial as engaged by the friction disk (e.g. brake pad), actually comprising a complex curve of varying radius.

Figure 7:
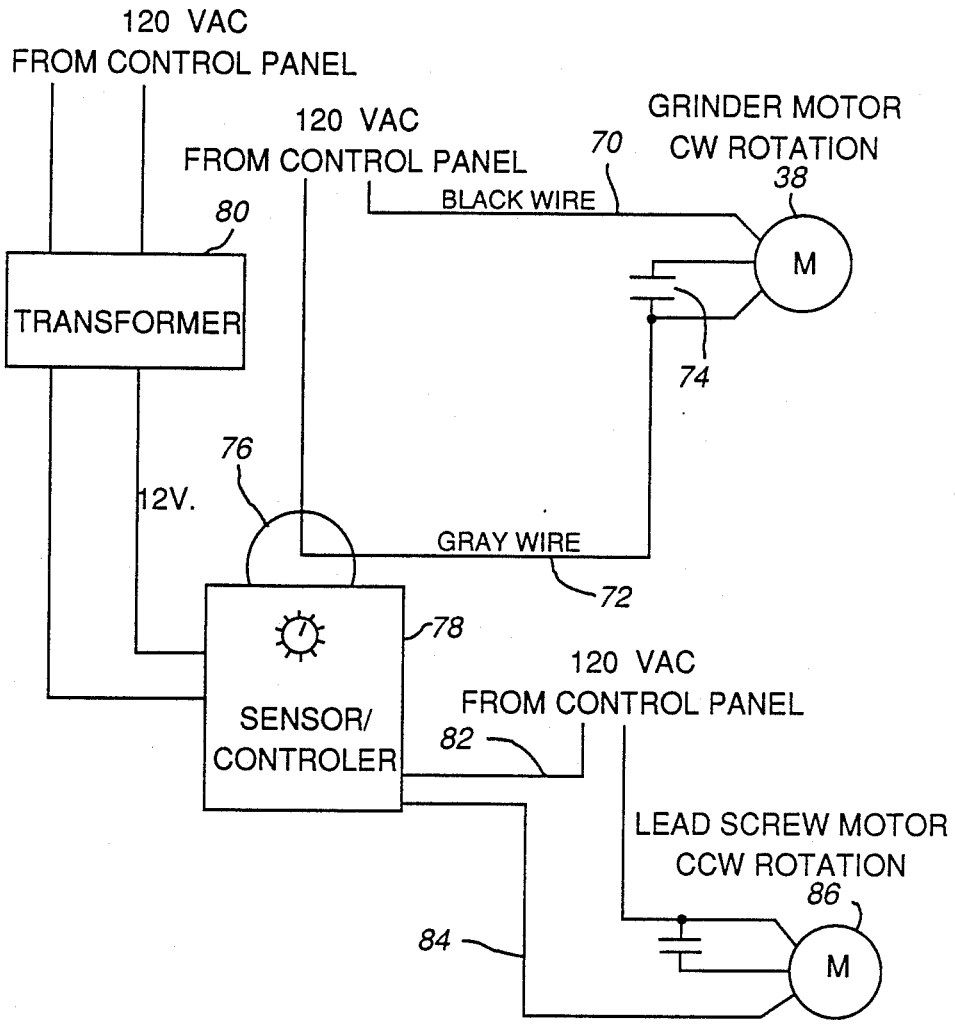
FIG. 7 is a schematic circuit diagram showing a fine grinding adjustment system preferably incorporated in the invention.

FIG. 7 shows schematically a circuit diagram for alternative type of control for advancing the abrading wheel against the flywheel or disk.

The system diagrammatically illustrated in FIG. 7 is associated with or can replace the fine adjustment of the coarse and fine adjustment shown and described above.

In the grinding control system shown in FIG. 7, which provides a very fine adjustment of the advancement of the abrading wheel and thus of the rate of grinding of the material off the face of the flywheel or disk, current draw of the grinding wheel motor 38 is monitored to determine the degree of pressure existing between the abrading wheel 30 and the flywheel or disk 12, and thus the rate of grinding.

In the system of FIG. 7, 120 volt AC current flows through the circuit defined by the black wire 70, the gray wire 72 and the motor 38. A starting capacitor 74 is included in the circuit. The gray wire 72 passes through a metal loop Hall effect sensor 76 which forms a part of a sensor/controller 78. As indicated, the sensor/controller 78 receives 12 volt current from a transformer 80.

The sensor/controller, which may be a Potter and Brumfield current sensor SDAS--017Y251024, is connected to control wires 82 and 84, in a circuit with a grinding wheel advancement motor or lead screw motor 86 as indicated. The lead screw motor 86, although not shown in FIGS. 1 through 4, can be assumed as connected to the fine adjustment knob 42 and shaft 52/56 in FIGS. 2 and 3. However, it can operate a lead screw advancing mechanism different from the illustrated mechanism if desired.

As indicated, the circuit with the lead screw motor or fine feed motor 86 is connected to 120 volt AC power, but this is subject to on/off control via the lead wires 82 and 84, under control of the sensor/controller 78.

In order to enable the operator to set and maintain a given grinding rate or pressure, an adjustment knob 88 on the sensor/controller 78 is set at a given amperage by the operator, e.g. three amps or five amps. The Hall effect sensor 76 senses whether the current to the grinder motor 38 is at or below the set level. If the amperage is below the set level on the adjustment knob 88, the sensor/controller will close the circuit with the lead wires 82 and 84 and power the lead screw motor 86 until current reaches the set level. When grinder motor current is at the set level, the sensor/controller 28 reopens the circuit, turning off the lead screw motor 86 and leaving the abrading wheel in the position then set.

The lead screw motor 36 may have an operating speed of about 7 rpm, so that it moves the abrading wheel 30 very slowly into closer contact with the flywheel or disk being surfaced. In the preferred embodiment of the invention, one revolution of the lead screw motor 36 or of the output of an included gear reduction box) preferably causes about 0.005 inch advancement of the abrading wheel 30.

Thus, by the abrading wheel feed control system shown in FIG. 7, very fine control of the surfacing/abrading process is made possible. The system also gives the operator a guideline by the current level adjustments set from time to time with different flywheels or disks, and helps achieve repeatable results.

The feed control system of FIG. 7 is applicable to other operations wherein a motor driven tool or implement, whether a grinder, polisher, sander, circular or band saw or other cutting surfacing operation, is moved into contact with a workpiece (rotating or still), or vice versa where the workpiece is moved toward the implement. The rate and pressure of feed of the workpiece or of the motorized tool can be closely controlled with this feed control apparatus.

The above described preferred embodiment is intended to illustrate the principles of the invention, but not to limit its scope. Other embodiments and variations to this preferred embodiment will be apparent to those skilled in the art and may be made without departing from the scope of the invention as defined in the following claims.

I claim:

1. A method of grinding and resurfacing flywheels or disks having at least one face with an annular frictional contact area and having a central hub area with at least one opening, and for producing on the frictional contact area a desirable surface pattern of curving lines generally transverse to the circumference of the flywheel or disk, comprising:

securing the flywheel or disk to a shaft via an opening in the hub area of the flywheel or disk, the shaft extending from a first housing secured to a table;

providing a motor-driven cup-shaped abrading wheel on a base connected to the table, with a rotational axis generally parallel to the shaft holding the flywheel or disk, and with position adjustment means in association with the base for advancing the abrading wheel substantially axially forward toward the flywheel or disk in position to contact the frictional contact area of the flywheel or disk, the abrading wheel being on a rotational axis which is slightly tilted with respect to the shaft with the flywheel or disk, so that only a portion of the abrading wheel in a single arc contacts the flywheel or disk at one time and being positioned so that only a portion of the wheel's abrasive surface overlaps the face of the flywheel or disk;

rotating the shaft with the flywheel or disk at a first predetermined speed at least about 400 rpm, and rotating the abrading wheel at a second predetermined speed at least about 3450 rpm;

advancing the abrading wheel toward and into contact with the frictional contact area of a face of the flywheel or disk, using the position adjustment means such that the single arc of contact of the tilted abrading wheel on the frictional contact area extends substantially only from the periphery of said central hub area to the outer edge of the flywheel or disk, until the frictional contact area is rendered substantially smooth and there is produced a desirable surface pattern comprising curving lines non-concentric with the flywheel or disk and positioned generally radially on the flywheel or disk essentially without crossing over each other, for promoting proper wear.

2. The method of claim 1, wherein the flywheel or disk and the abrading wheel are rotated in the same direction.

3. The method of claim 1, further including providing means for varying the speed of rotation of the flywheel or disk.

4. The method of claim 1, wherein the position adjustment means includes a coarse adjustment means and a fine adjustment means.

5. The method of claim 1, further including adjusting and controlling the pressure with which the abrading wheel bears against the disk face by sensing the level of current drawn by a motor of the motor-driven abrading wheel, and advancing the abrading wheel against the disk face in a fine adjustment mode until a desired level of current is drawn by the motor, indicating a desired level of frictional resistance between the abrading wheel and the disk face.

6. The method of claim 5, wherein the advancing of the abrading wheel is accomplished with a lead screw motor rotating a lead screw at low rpm so as to advance the abrading wheel slowly in a fine adjustment, and including automatically controlling the fine adjustment by manually setting a desired current level on a sensor/controller which senses current level to the abrading wheel motor, and closing a circuit supplying power to the lead screw motor when sensed current is below said desired current level and opening the circuit when sensed current reaches said desired current level.

7. An apparatus for surfacing a face of a flywheel or disk having at least one face with an annular frictional contact area, and a central hub area with a central hole, and for generating a desired surface pattern on the frictional contact area, comprising a table;

means for supporting the flywheel or disk generally from its center, said supporting means being secured to the table;

means for causing the flywheel or disk to rotate in a first angular direction, including a first driven shaft having an axis about which flywheel or disk rotates, said supporting means comprising a support plate secured to the first driven shaft and means for securing the flywheel or disk against the support plate by engaging the central hole in the flywheel or disk;

an abrasive surface;

a cup-shaped abrading wheel having abrading adjustment means for adjusting the axial position of the abrading wheel, including a coarse adjustment means and a fine adjustment means, for engaging the abrading wheel against the flywheel or disk face and for controlling the depth to which the disk face is abraded;

base means for supporting the abrading wheel such that the abrasive surface is slightly tilted with respect to the flywheel or disk face, said base means including a second shaft supporting said abrasive wheel, said second shaft being slightly tilted with respect to and offset from the first shaft such that the abrading wheel makes a single arc of contact with the flywheel or disk face, said single arc of contact extending substantially only from the periphery of said central hub area to the outer edge of the brake disk; and motor means for driving the abrading wheel on an axis of the second shaft in the same angular direction as the rotation of the flywheel or disk, and such that only a portion of the wheel's abrasive surface overlaps the face of the disk;

whereby there is formed on the flywheel or disk face a surface pattern of curving lines not concentric with the disk and generally radially disposed on the disk and essentially not crossing over each other, for promoting proper wear of the flywheel or disk face.

8. The apparatus of claim 7, wherein said means for securing the flywheel or disk onto the support plate comprises a tapered centering member engaged through the central hole in the flywheel or disk, and a threaded centering bolt engaged with the support plate for drawing the centering member against the hole in the flywheel or disk to center the flywheel or disk and hold it tightly against the support plate.

9. The apparatus of claim 7, wherein the coarse adjustment means and the fine adjustment means comprise a screw-threaded coarse adjustment shaft generally parallel to the axis of the abrading wheel and journaled for rotation in the base means, a retaining bracket secured to the table and preventing axial movement of the coarse adjustment shaft while permitting rotation thereof, a coarse adjustment knob secured to the end of the coarse adjustment shaft for manual rotation thereof, a worm gear member in threaded engagement on the coarse adjustment shaft, spacer sleeves slidable over the coarse adjustment shaft, positioned to engage the base means and to hold the worm gear member against axial movement with respect to the base means and to transfer axial forces from the worm gear member to the base means to shift the position of the base means axially with respect to the coarse adjustment shaft in response to manual rotation of the shaft, a fine adjustment shaft journaled for rotation in the base means and perpendicular to the coarse adjustment shaft, and a worm fixed on the fine adjustment shaft and in engagement with the worm gear, whereby manual rotation of the fine adjustment shaft will effect very slow rotation of the worm gear while the coarse adjustment shaft remains non-rotational, causing the worm gear to advance very slowly along the coarse adjustment shaft and effecting fine adjustment movement of the base means.

10. The apparatus of claim 7, further including means for adjusting and controlling the pressure with which the abrading wheel bears against the disk face by sensing the level of current drawn by the motor means of the motor-driven abrading wheel, and including advancing means for advancing the abrading wheel against the disk face in a fine adjustment mode until a desired level of current is drawn by the motor means, indicating a desired level of frictional resistance between the abrading wheel and the disk face.

11. The method of claim 10, wherein the advancing means comprises a lead screw motor rotating a lead screw at low rpm so as to advance the abrading wheel slowly in a fine adjustment, and including control means for automatically controlling the fine adjustment level and sensor/controller means for sensing current level to the abrading wheel motor means, and for closing a circuit supplying power to the lead screw motor when sensed current is below said desired current level and opening the circuit when sensed current reaches said desired current level.

* * * * *